United States Patent [19]

Finney

[11] Patent Number: 4,898,387

[45] Date of Patent: Feb. 6, 1990

[54] GOLF CLUBHEAD WITH A HIGH POLAR MOMENT OF INERTIA

[76] Inventor: Clifton D. Finney, 1057 Oak Hills Pkwy., Baton Rouge, La. 70810

[21] Appl. No.: 289,908

[22] Filed: Dec. 27, 1988

[51] Int. Cl.[4] ..... A63B 53/04

[52] U.S. Cl. ..... 273/167 F; 273/169; 273/171; 273/173

[58] Field of Search ..... 273/77 R, 77 A, 167 R, 273/167 F, 169–172, 167 G, 173, 167 H, 167 D; D21/217–220

[56] References Cited

U.S. PATENT DOCUMENTS

| | | | |
|---|---|---|---|
| D. 123,260 | 10/1940 | Flynn | D21/118 |
| D. 248,783 | 8/1978 | Long | 273/167 F X |
| 1,133,129 | 3/1915 | Govan | 273/171 |
| 1,901,562 | 3/1933 | Main | 273/169 |
| 3,305,235 | 2/1967 | Williams | 273/81.2 |
| 3,516,674 | 6/1970 | Scarborough | 273/169 |
| 3,873,094 | 3/1975 | Sebo et al. | 273/167 R X |
| 3,941,390 | 3/1976 | Hussey | 273/171 X |
| 3,966,210 | 6/1976 | Rozmus | 273/169 |
| 4,010,958 | 3/1977 | Long | 273/169 |
| 4,213,613 | 7/1980 | Nygren | 273/169 |
| 4,280,700 | 7/1981 | Plagenhoef | 273/169 X |
| 4,444,395 | 4/1984 | Reiss | 273/171 |
| 4,471,961 | 9/1984 | Masghati et al. | 273/169 X |
| 4,508,350 | 4/1985 | Duclos | 273/183 |
| 4,607,846 | 8/1986 | Perkins | 273/171 |
| 4,650,191 | 3/1987 | Mills | 273/169 X |
| 4,655,459 | 4/1987 | Antonious | 273/171 |
| 4,687,205 | 8/1987 | Tominaga et al. | 273/169 |
| 4,693,478 | 9/1987 | Long | 273/164 |
| 4,695,054 | 9/1987 | Tunstall | 273/171 |
| 4,714,252 | 12/1987 | Roraback | 273/171 |
| 4,754,977 | 7/1988 | Sahm | 273/171 |
| 4,762,324 | 8/1988 | Anderson | 273/164 |

FOREIGN PATENT DOCUMENTS

| | | | |
|---|---|---|---|
| 304008 | 1/1929 | United Kingdom | 273/169 |

OTHER PUBLICATIONS

"Need a New Putter", by Lew Fishman, *Golf Digest*, Dec. 1988, pp. 96–99.

"Long Green Glider" as seen in *Golf World*, May 28, 1976, p. 19.

*Primary Examiner*—Edward M. Coven

*Assistant Examiner*—Sebastiano Passaniti

[57] ABSTRACT

There is disclosed a putter head no longer, no wider, no higher, nor heavier than ordinary at 5.0×2.0×1.2 inches and 302 grams. Yet, it has a polar moment of inertia about 8300 g-cm$^2$.

The polar inertial efficiency of a golf clubhead is defined as its actual moment of inertia divided by its maximum theoretical polar moment of inertia.

The theoretical polar moment of inertia is an intrinsic property of every golf clubhead. It is determined by positioning half the mass of the head at a toe point and the other half at a heel point a heel-to-toe length apart, and then calculating the polar moment of inertia from the center of mass for the system. Thus, for the preceeding head the theoretical moment of inertia is 12,200 g-cm$^2$ giving an inertial efficiency in excess of 0.69.

By comparison, the polar inertial efficiency of any thin bar is shown to be 0.33. Prior art clubheads generally have inertial efficiencies close to this value, with the best clubheads having values slightly larger.

The putter head includes a low density striking face of alumininum and a toe section with a lead weight. The toe weight has an expanded surface area along the toe.

Mechanical expressions are developed which provide insight for the design of a clubhead with a high polar moment of inertia. The expressions involve masses, densities, lengths, and surface areas. It is also shown that a correctly designed, weighted clubhead is superior to a similar, un-weighted clubhead.

17 Claims, 4 Drawing Sheets

GOLF CLUBHEAD WITH A HIGH POLAR MOMENT OF INERTIA

BACKGROUND—FIELD OF INVENTION

This invention relates to golf clubheads with highly enhanced polar moments of inertia to reduce twisting when a golf ball is struck.

BACKGROUND—DESCRIPTION OF PRIOR ART

One of the most fundamental challenges that confronts a golfer is the control of the flight of the ball. Even the finest of amateurs and professionals using the best peripherally weighted clubs occasionally is amazed by what happens when a shot is miss-hit off the sweet-spot of a clubface. A player wathces a drive hook out of bounds, or an iron slide right of a green into a bunker, or an four foot putt fall off at what seems to be a 45° angle from the hole. This latter problem, accurate putting, is crucial because of its direct ties to scoring.

Heretofore some golf club designers have approached the problem of twisting by regarding a clubhead to be a free flying weight attached to a shaft. A classical teaching on the reduction of the angle of twist of a clubhead at impact may be found in patent No. 1,901,562, Mar. 14, 1933. For drivers, putters, and the like. Main taught construction of a clubhead of a low density material like wood with heel and toe weights of a high density material like lead. The purpose of the weights was to yield a maximal moment of inertia about the vertical axis of rotation at the center of mass between the heel and toe of the clubhead to resist the twisting forces.

Qualitatively, at least, Main's effort recognized the relationship of four entities. These involved mass, density, and length combining somehow or other to yield an enhanced value for the polar moment of inertia.

Recent work on clubhead design has begun to emphasize a more quantitative approach to the problem of moment of inertia. For example, patent No. 4,508,350, Apr. 2, 1985 by Duclos taught a clubhead, specifically a bimetallic putter of aluminum and lead, where about 67% of the the total mass of up to 335 grams was fixed in place as lead slugs in heel and toe cavitations opposite a striking face about 4.8 inches long. The head had a reported moment of inertia of 5000 g-cm$^2$.

In an apparent contradiction of the superiority of the approach of separating high density and low density masses as the best path to a high polar moment of inertia, patent No. 4,693,478, Sept. 15, 1987 by Long taught a monometallic putter of aluminum. A putter of this type that weighed 290 grams and was 6.25 inches long had a polar moment of inertia of 6260 g-cm$^2$.

To understand and reconcile these results and to provide a conceptual foundation for the current invention, we formulate a definition for a new entity, inertial efficiency. Let the inertial efficiency, E, for a clubhead be the ratio of its actual experimental or computed polar moment of inertia inertia, $I_a$, to its theoretical moment of inertia, $I_t$. The actual moment of inertia can be taken from a vertical axis about the center of mass or the geometric center of the ball striking surface. A vertical axis about the center of mass will be used herein for theoretical and hypothetical discussion. A vertical axis about the geometric center of the striking face will be used herein and in the appended claims for practical purposes.

$$E=I_a/I_t \qquad \text{(EQN. 1).}$$

Let the definition for the theoretical moment of inertia, $I_t$, for a clubhead of mass, m, and heel-to-toe length, l, be the moment of inertia the clubhead would have if its mass were divided in two with the half-masses placed at pinpoints a length, l, apart and the moment determined through a vertical axis at the midpoint, or center of mass.

Also, USGA's definition of clubhead dimensions for length and breadth provide helpful guidance:

Appendix II. Rule 4.1.d. Clubhead

The length and breadth of a clubhead are measured on horizontal lines between the vertical projections of the extremities when the clubhead is soled in its normal address position. If the heel extremity is not clearly defined, it is deemed to be 0.625 inches (16 mm) above the sole.

The following more detailed definitions for length, width, and height all assume a clubhead soled in its normal address position. This assumption and the resultant definitions apply throughout the specification and in the appended claims.

Length is taken to mean the horizontal length between vertical projections of imaginary parallel planes placed at the extremities of the toe and heel, respectively, or 0.625 inches above sole if the heel is not clearly defined. When the striking face is planar, the imaginary planes should be placed perpendicular to the plane of the striking face. When the striking face is convex, or bulging, then the imaginary planes should be placed perpendicular to a horizontal length line tangent to the geometric center of the striking face.

Breadth is taken as the horizontal width between vertical projections of imaginary parallel planes placed at the extremities of the front, or striking face, side and opposite rear, or butt, side of the clubhead, respectively, so that they are perpendicular to the set of imaginary planes used to determine the length, and parallel to the length line itself.

The definition of the height for a clubhead is not provided, but it is now defined as the vertical height between respective horizontal projections of imaginary parallel planes placed at the ground surface and the highest vertical point of the head excluding the hosel and any neck to the hosel. Thusly, length, breadth, and height form a mutually perpendicular set.

Returning to the theoretical moment of inertia, since it is determined from a vertical axis midway between the heel-to-toe length, $I_t=2(m/2)(\frac{l}{2})^2$, or $$I_t=\tfrac{1}{4}\,ml^2 \qquad \text{(EQN. 2).}$$

At the outset, it is necessary to emphasize the arbitary nature of the definition and magnitude of $I_t$. Accordingly, $I_t$ might be made greater by selecting the distance through, say, the center of mass along a length-breadth diagonal of a clubhead. However, at least two factors argue against this and other possible definitions: (i) they would not be so clear and convenient, and (ii) they are unnecessary since to date actual moments of inertia, $I_a$, on clubheads have been well below the minimal $I_t$ we have selected to define and use.

A hypothetical example will further clarify the significance of inertial efficiency. Assume a golf clubhead to be a 300 gram, five (5) inch bar. The classical example of a putter head as near-bar may be found in patent No. D123,260, Oct. 29, 1940 by Flynn. As seen in undergraduate physics texts such a bar would have a polar moment of inertia about a vertical axis through its center of mass approximated by, $$I_a(\text{bar}) = 1/12\ \text{ml}^2. \qquad \text{(EQN. 3).}$$

In a subsequent section, the assumptions behind the development of such equations and the errors resulting from their use will by analyzed. It will be shown that for systems of the type under consideration here, the calculated values always yield polar moments of inertia that are slightly less than good experimental values. It is also felt that the retention of such one-dimensional equations, in addition to permitting quick and conservative approximations, helps to provide significant insight into the problem of clubhead design.

The inertial efficiency of the bar may now be determined by either of two pathways. Firstly, direct substitution from EQN. 3 for $I_a$ and EQN. 2 for $I_t$ into EQN. 1, gives the inertial efficiency of any small bar of any mass and length as a constant at $E=0.33$.

Secondly, the actual values of moment of inertia may be substituted for the given bar into EQN. 1. Hence we have $I_a = 1/12(300)(12.7)^2$ and $I_t = \frac{1}{4}(300)(12.7)^2$. This gives values of $I_a = 4030$ g-cm$^2$ and $I_t = 12{,}100$ g-cm$^2$. Of course, division of $I_a$ by $I_t$ again gives $E=0.33$.

Some conclusions may now be drawn. It has become apparent that moments of inertia of 5000–6260 g cm$^2$ in patent Nos. 4,508,350 and 4,693,478 discussed above were considerably less than the theoretical maxima in the range of 12,000 g-cm$^2$ and beyond. Indeed using the data given above, the inertial efficiency of the bimetallic putter head was 0.40 due to its superior mass separation while that of the monometallic putter head was 0.34. Thus, the higher value of moment of inertia for the latter putter head was due primarily to its greater length.

It has also become slightly more clear that Main's qualitative approach of separating mass and density is quite sound. From the bar example we can begin to see that if mass is taken away from the middle of a clubhead and added toward the poles of the clubhead, the inertial efficiency will increase. Regarding density, it is possible to go beyond Main conceptually. It is seen that if somehow the masses could be added as something approximating pinpoints of very dense material at the extreme polar regions of a clubhead, the inertial efficiency would increase even more. A central question of this investigation becomes how to arrive at an extreme polar architecture which, for practical purposes, approximates heavy, dense pinpoints.

To summarize, we have been given a vague and controversial qualitative theory that suggests masses, densities, and lengths can combine in golf clubheads somehow to promote a higher polar moment of inertia. Recently, laudatory steps have been taken to quantify experimental determinations of polar moments of inertia on golf putter heads. However, the values of inertial efficiencies and polar moments of inertia obtained represent only a step beyond that expected for a clubhead as a near-bar. Finally, there do not appear to be any conceptual or practical barriers to realizing much higher values for polar inertial efficiencies and moments of inertia on golf clubheads.

In the presentation of this and the following sections certain terms such as the geometric center of the striking face and the toe section of the clubhead are referred to. Eventually these will be defined operationally, but for the present they may be taken as descriptive. Accordingly, toe section refers to the entire half of the clubhead from the geometric center of the ball striking surface to the toe.

Throughout the discussion including the appended claims emphasis is placed on the toe section. This is so because the heel section of most club contains a hosel to attach a shaft. The shaft in turn, often at its bottom near the hosel, may contain weights. The mass from the hosel, shaft, and any weights contributes significantly to the moment of inertia and inertial efficiency of the complete club. Also, to offset this mass the toe section is typically heavier than the heel section on heel-shafted clubs.

In order to proceed while simultaneously avoiding the infinity of complications due to hosel, hosel position, shaft, and shaft weights, effort is concentrated on the toe section of the clubhead. However, consideration of inertial balance dictates that a complete golf club with a toe section having a high polar moment of inertia must have a combination of heel section, shaft, and shaft weights yielding a similar value. One forces the other.

Also, the arbitrary slicing of the clubhead into a toe section and a heel section effectively divides the weight material. Thus toe weight and heel weight may be regarded to be separate or quantized whether or not they are actually joined. This is of practical interest in the appended claims.

OBJECTS AND ADVANTAGES

Accordingly, the several objects and advantages of my invention begin with a golf clubhead comprising a means for attaching a shaft, a toe section and a heel section, and a body casting of a first material of a first predetermined density that includes a ball striking surface and a toe cavity with an attached weight of a second material of a second predetermined density greater than the first.

Another object involves arranging the mass of the toe section so that the polar moment of inertia of the toe section along a vertical axis through the geometric center of the ball striking surface is enhanced.

Yet another provides that the toe weight should have an expanded surface from front to back. This requirement for an expanded surface may result in a wall-like configuration of a portion of the toe weight.

Still another provides that a substantial portion of the toe weight be positioned behind the striking face in the region of the toe.

Again another object of the current invention includes attaching the toe weight so that there is a large ratio for the horizontal length between the vertical axis through the geometric center of the ball striking surface and the closest point of a substantial portion of the toe weight relative to the half-length of the clubhead.

Another object provides for attaching the toe weight to the toe cavity so that its center mass is positioned behind the striking face in the region of the toe.

Yet another object of my invention provides for attaching the toe weight so that there is a large ratio for the horizontal length between the vertical axis through the geometric center of the ball striking surface and the center of mass of the toe weight relative to the half-length of the clubhead.

Still another object is to have a toe section where a high proportion of the total mass is deposited in the weight.

A further object is to have a toe section wherein the ratio of the density of the weight to the density of the body casting is large.

Yet a further object includes having a toe section with an enhanced inertial efficiency. Thus, neither the toe section nor the clubhead need necessarily be heavier, longer, broader, or higher than ordinary.

Still a further object of the current invention is to present expressions which help in the design of a clubhead with a high polar moment of inertia. A closely associated object is to demonstrate the point that the lower the first predetermined density and the higher the second predetermined density, the greater the moment of inertia for a clubhead. Too, it is shown why a properly designed clubhead with a weight or weights may be generally superior to a similar one with none. Also, methods for quickly calculating conservative values for polar moments of inertia and inertial efficiencies are presented.

Other objects and advantages of the current invention are to provide a golf clubhead that yields a good solid feel when a ball is struck; is aesthetically appealing to golfers; is readily constructed with the preferred process of body casting; and is commercially attractive for both manufacturer and golfer.

Still more objects and advantages of my invention will become apparent from the drawings and ensuing descriptionn of it.

NUMERIC CODE

Figure 1:
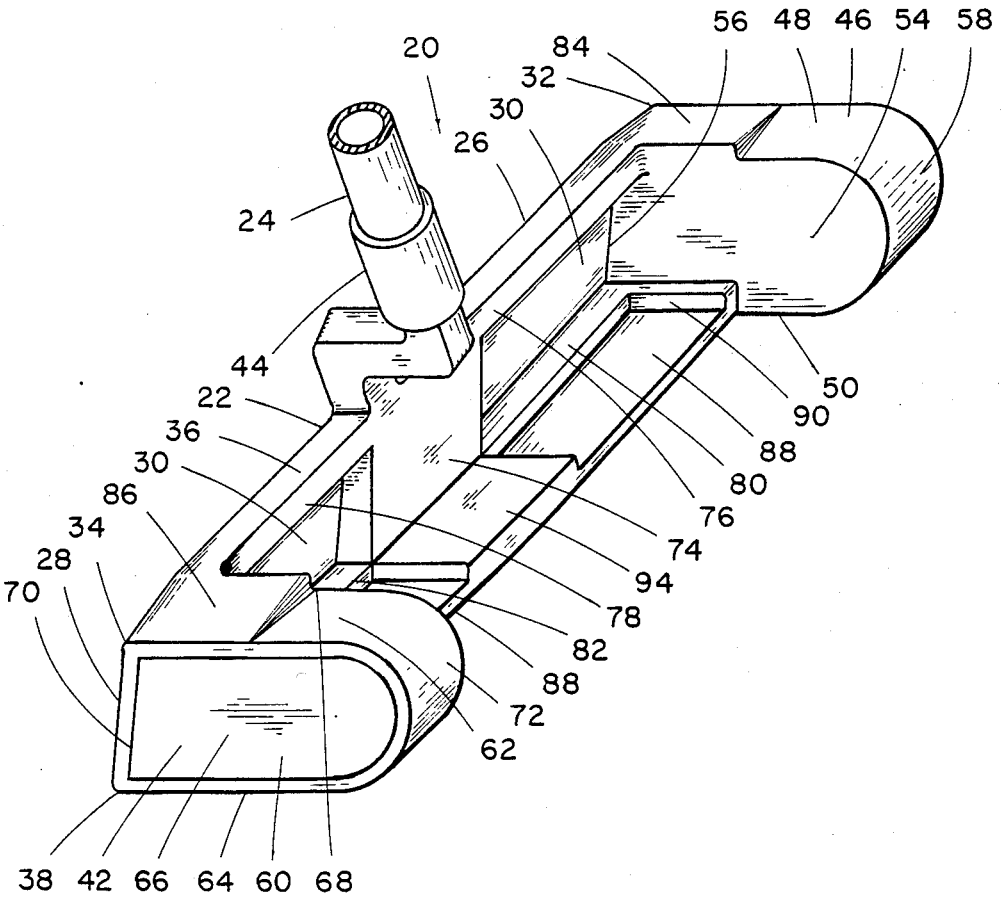
FIG. 1 is a perspective view of the putter head of the present invention.

1-12: FIGURES
20-99: PARTS OF A PREFERRED EMBODIMENT—FIGS. 1-6
100-199: POINTS—FIGS. 1-6
200-299: AXES, LINES, SURFACES, AND ANGLES—FIGS. 1-6
300-399: DIMENSIONS—FIGS. 1-6
400-499: SCHEMATIC DIAGRAMS—FIGS. 7-12

PARTS OF A PREFERRED EMBODIMENT—FIGS. 1-6

20 golf club putter
22 head
24 shaft
26 body casting
28 ball striking surface
30 back surface
32 toe
34 heel
36 top
38 sole or bottom
40 toe weight
42 heel weight
44 hosel and neck
46 toe cavity for attaching a toe weight 40
48 top side of toe cavity 46
50 bottom side of toe cavity 46
52 open outer side of toe cavity 46
54 inner side of toe cavity 46
56 shared front side of toe cavity 46 toward back surface 30
58 rounded back side of toe cavity 46
60 heel cavity for attaching a heel weight 42
62 top side of heel cavity 60
64 bottom side of heel cavity 60
66 open outer side of heel cavity 60
68 inner side of heel cavity 60
70 shared front side of heel cavity 60 with back surface 30
72 rounded back side of heel cavity 60
74 muscle-back brace
76 toe-side top brace
78 heel-side top brace
80 toe-side bottom brace
82 heel-side bottom brace
84 toe cavity brace
86 heel cavity brace
88 extended sole
90 side brace on extended sole 88 to toe cavity 46
92 side brace on extnded sole 88 to heel cavity 60
94 middle brace on extended sole 88
96 toe section
98 heel section

POINTS—FIGS. 1-6

100 center off mass of head 22
102 center of mass of toe weight 40
104 center of mass of heel weight 42
106 geometric center of the ball striking surface 28
108 center of golf ball circumference 202
110 closest point of toe weight 40 from vertical axis 206 through geometric center 106 of ball striking surface 28

AXES, LINES, SURFACES, AND ANGLES—FIGS. 1-6

200 horizontal ground surface
202 circumferencce of a golf ball
203 partial horizontal circumference of a circle with axis 206 as center and length 303 as radius
204 angle of twist of head 22 when a ball as represented by circumference 202 is miss-struck a distance 311 from the preferred spot
206 vertical axis through geometric center 106 of ball striking surface 28 when head 22 is soled in its normal address position on ground surface 200
207 partial horizontal circumference of circle with axis 206 as center and length 307 as radius

DIMENSIONS—FIGS. 1-6

By way of reminder, each of the following definitions assume head 22 is soled in its normal address position on horizontal ground surface 200.

301 horizontal length of head 22 between vertical projections of imaginary parallel planes from the extreme of toe and 32 and extreme of heel end 34
302 half the length 301 of head 22 as referenced from the extreme of toe end 32
303 direct horizontal length from the vertical axis 206 through the geometric center 106 of the ball striking surface 28 to the closest point 110 of the toe weight 40
304 horizontal length of toe weight 40 between vertical projections of imaginary parallel planes from extreme toward toe 32 and extreme toward heel 34 along a line parallel with length 301
305 vertical height of toe weight 40 between horizontal projections of imaginary parallel planes from extreme toward top 36 and extreme toward bottom 38 along a line perpendicular to 301
306 horizontal width of toe weight 40 between vertical projections of imaginary planes from extreme toward ball striking surface 28 and extreme away from ball striking surface 28 along a line perpendicular to 301
307 direct horizontal length from the vertical axis 206 through the geometric center 106 of the ball striking surface 28 to the center of mass 102 of toe weight 40
308 vertical height of head 22 between horizontal projections of imaginary parallel planes from extreme toward top 36 excluding hosel 44 and ground surface 200 on a line perpendicular to 301
309 half the maximum vertical height 308 as referenced from ground surface 200
310 horizontal width of head 22 between vertical projections of imaginary planes from extreme toward ball striking surface 28 and extreme away from ball striking surface 28 on a line perpendicular to 301
31 horizontal length the center 108 of a golf ball as represented by circumference 202 is miss-struck off the preferred ball striking spot here represented as a point along a vertical line between the geometric center 106 of the ball striking surface 28 and the top 36

SCHEMATIC DIAGRAM—FIG. 7

400 point for toe at which half of the mass is located
402 point for heel at which half of the mass is located
404 center of mass
406 length between the point for toe 400 and point for heel 402
408 axis through center of mass 404 perpendicular to length 406

SCHEMATIC DIAGRAMS—FIGS. 8 AND 9

410 solid bar
412 toe
414 heel
416 center of mass
417 vertical axis through center of mass 416
418 length between extreme of toe 412 and extreme of heel 414
419 cross-sectional area
420 breadth of solid bar 410
422 length-breadth diagonal distance of solid bar 410
424 plane splitting the breadth 420 of solid bar 410

SCHEMATIC DIAGRAM—FIG. 10

430 hollow bar
432 toe
434 heel
436 center of mass of hollow bar 430 and weights 438 and 440
437 vertical axis through center of mass 436
438 toe weight
440 heel weight
441 length of hollow bar 430 from extreme of toe end 432 to extreme of heel end 434
442 half the length 441 of hollow bar 430 from extreme of toe 432 to center of mass 436
443 length from center of mass 436 to toe weight 438
444 length of toe weight 438
445 height of toe weight 438
446 breadth of toe weight 438
448 height of hollow bar 430
450 breadth of hollow bar 430

SCHEMATIC DIAGRAM—FIG. 11

460 modified hollow bar
462 toe
464 heel
466 facial edge
468 toe weight
470 heel weight
472 half length of modified hollow bar 460 along facial edge 466 from extreme of toe 462
473 direct length from vertical projection through middle of facial edge 466 to the vertical projection of the closest point of toe weight 468
477 direct length from vertical projection through middle of facial edge 466 to vertical projection from center of mass of toe weight 468

SCHEMATIC DIAGRAM—FIG. 12

480 re-modified hollow bar
482 toe
484 heel
486 facial edge
488 toe weight
490 heel weight
492 half length of re-modified hollow bar 480 along facial edge 486 from extreme of toe 482
493 direct length from vertical projection through middle of facial edge 486 to the vertical projection from the closest point of toe weight 488
497 direct length from vertical projection through middle of facial edge 486 to vertical projection from center of mass of toe weight 488

DETAILED DESCRIPTION OF A PREFERRED EMBODIMENT

Figure 2:
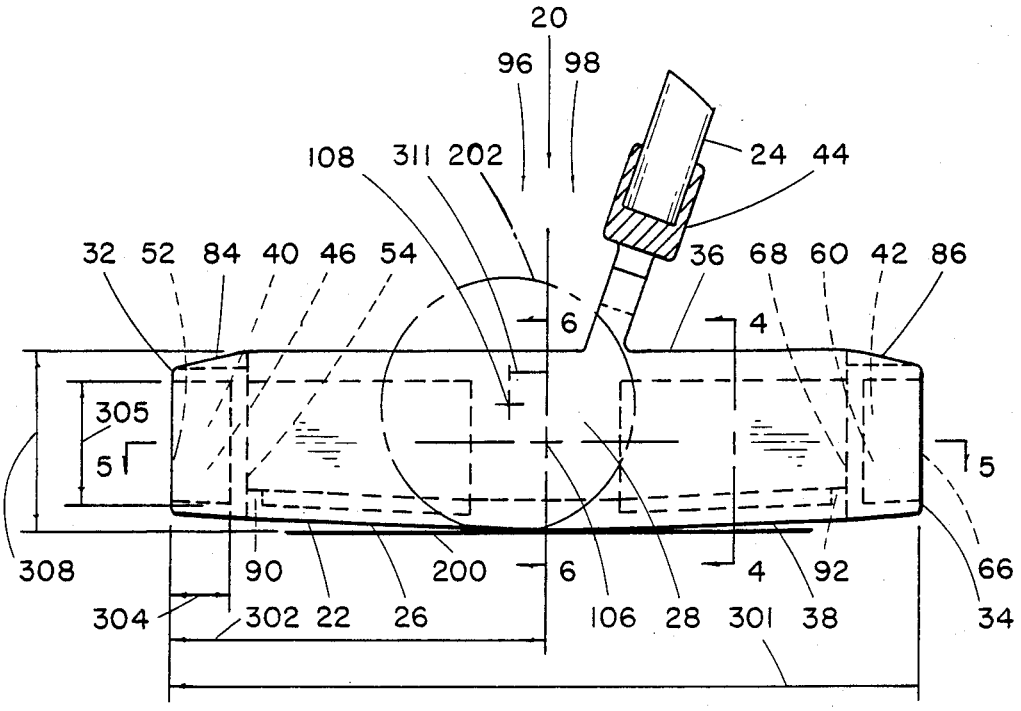
FIG. 2 is a front elevation view of the putter head of the present invention.
Figure 3:
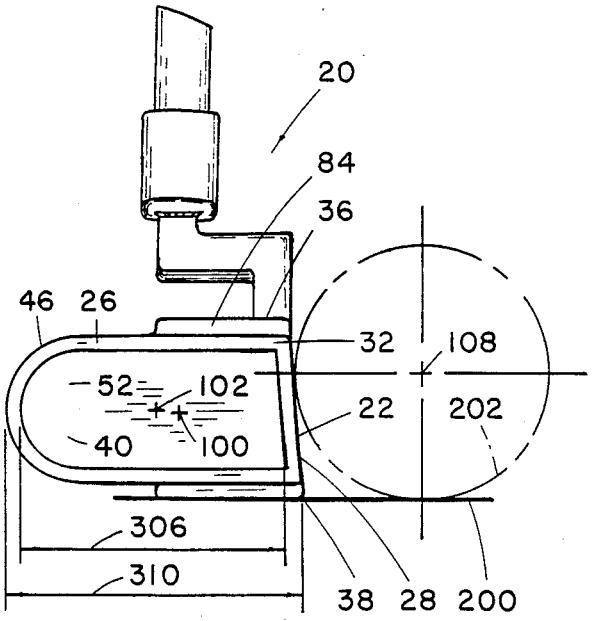
FIG. 3 is a side elevation view of the toe and of the putter head of the present invention.

With regard to FIG. 1, number 20 refers to a golf club putter of the current invention. It consists of a head 22 with means for joining a shaft 24 via the body casting 26. Head 22 has a ball striking surface 28 which may be seen in its entirety in FIG. 2. There is also a back surface 30, a toe 32, a heel 34, a top 36, and a sole 38. The toe weight 40 is seen more fully in the side elevational view of FIG. 3 and the top cross-sectional view of FIG. 5. The heel weight 42 in FIG. 1 can also can be seen in cross-section in FIG. 5. With the exception of shaft 24 and weights 40 and 42, head 22 is a single, integral body casting 26. In FIGS. 1–3, hosel 44 serves as means by which shaft 24 is adhesively joined to head 22.

Head 22 also has a toe cavity 46 as means for attaching toe weight 40. Toe cavity 46 consists of a top side 48, bottom side 50, inner side 54, and rounded backside 58. Its front side 56 is shared with back surface 30. Similarly, head 22 also has a heel cavity 60 to attach the heel weight 42. It has a top side 62, bottom side 64, inner side 68, and rounded backside 72. Its front side 70 is also shared with back surface 30. Each of the cavities has an open side: for toe cavity 46 it is side 52 as seen in FIG. 3; and returning to FIG. 1, it is side 66 for heel cavity 60.

Body casting 26 also has an extensive integral system of braces to increase structural strength and to eliminate unwanted vibration. Notable among these is the muscle-back brace 74 contiguous with the back surface 30 from the top 36 to the sole 38.

Toe-side top brace 76 and toe-side bottom brace 80 are contiguous with back surface 30 from the muscle-back brace 74 to closed inner side 54 of toe cavity 46. Similarly, heel-side top brace 78 and heel-side bottom brace 82 are contiguous with back surface 30 from the muscle-back brace 74 to the closed inner side 68 of heel cavity 60.

The triangular shape of the toe cavity brace 84 contiguous with back surface 30 on the top side 48 from the inner side 54 to the open outer side 52 of toe cavity 46 is most clearly seen in FIG. 2. There is also a union of the toe cavity brace 84 with toe-side top brace 76. Similar comments apply to heel cavity brace 86 which is also contiguous with back surface 30 on the top side 62 from the inner side 68 to the open outer side 66 of heel cavity 60. It is also in union with heel-side top brace 78.

In addition to being a supporting medium for leveling the putter head 22, an extended sole 88 contiguous with muscle-back brace 74 and bottom braces 80 and 82 from the inner side 54 of toe cavity 46 to the inner side 68 of heel cavity 60 is a brace for the cavities. Reinforcement is provided by the side brace 90 on extended sole 88 and inner side 54 of toe cavity 46 joining toe-side bottom brace 80, and by side brace 92 on extended sole 88 and inner side 68 of heel cavity 60 joining heel-side bottom brace 82.

The middle brace 94 on extended sole 88 forms a union with muscle-back brace 74. Together, middle brace 94 and muscle-back brace 74 help prevent unwanted vibrations on the longer ball striking surface 28 and extended sole 88, respectively. They also provide support for the golfer who desires a ball striking surface 28 directly backed by solid material. Thus, there is a trade-off. Middle brace 94 and muscle-back brace 74 represent a small amount of material in an undesirable location from the perspectives of polar moment of inertia and inertial efficiency, but material well situated from the perspectives of reduced vibration and appeal to the golfer.

Referring to the front elevation of view of putter 20 as seen in FIG. 2, all the hidden lines in head 22 are shown. Also hosel and neck 44, but not cut-off shaft 24, is shown in partial cross-section. Head 22 is soled in its normal address position with respect to ground surface 200. Horizontal length 301 between vertical projections from the extremes of the toe 32 and the heel 34 is the heel-to-toe length for head 22.

Half-length 302 in FIG. 2 from the toe 32 is half of length 301. Half-length 302 defines the position of vertical cut-plane 6—6 which is perpendicular to both ground surface 200 and length line 301. Cut plane 6—6 divides the head 22 into a toe section 96 and a heel section 98. As seen in FIG. 2, hosel and neck 44 and shaft 24 accompany the heel section 98. This will be true for almost all center-shafted putter heads such as head 22 and for all heel-shafted putters, irons, woods, and other utility clubs.

Figure 6:
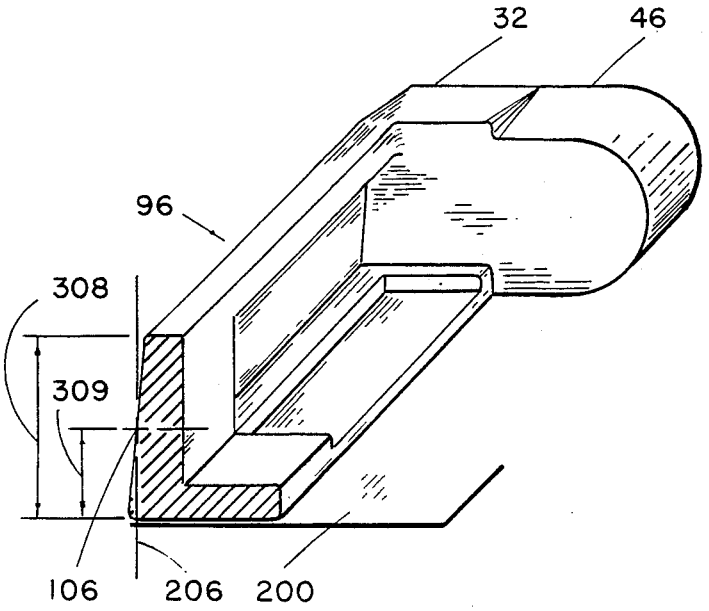
FIG. 6 is a cross-sectional perspective view of the toe section of the putter head of the present invention as shown along the line 6—6 of FIG. 2.

The half-length 302 in FIG. 2 also sets one of the coordinates for the geometric center 106 of the ball striking surface 28 of head 22. The other coordinate for geometric center 106 is the half-height 309 from the the ground surface 200 which is derived from vertical height 308 as seen in FIG. 6.

Vertical height 308 of head 22 is determined between horizontal projections from the extreme toward the top 36 excluding hosel and neck 44 and from ground surface 200 on a line perpendicular to 301 as seen in FIG. 2. In this embodiment the highest point of head 22 is seen to be anywhere on top 36 inside of toe and heel cavity braces 84 and 86, respectively, excluding the region where top 36, hosel and neck 44, and muscle-back brace 74 intersect. This will not be true generally. On most iron clubs, for example, the highest point on head 22 excluding hosel 44 from ground surface 200 will be near the end 32 of toe section 96.

Returning to the definition of the geometric center 106; it is generally determined by a horizontal projection of a line to a point onto the ball striking surface 28 from an intersection of length lines 302 and 309 so that the projected line is perpendicular to both length lines. Also, horizontal cut plane 5—5 passes through the geometric center 106 of the ball striking surface 28.

Also shown in FIG. 2 is horizontal length 304 of toe weight 40 between vertical projections from the extreme toward the toe 32 and the extreme toward the heel 34 along a line parallel with 301. Similarly, there is vertical height 305 of toe weight 40 between horizontal projections from the extreme toward top 36 of the extreme toward bottom 38 along a line perpendicular to 301.

It is seen in FIG. 2 that within cavities 46 and 60, the open outer sides 52 and 66, respectively, are shorter in height by a few hundredths of an inch than inner sides 54 and 68. When melted weights 40 and 42 are poured into cavities 46 and 60, respectively, and solidified this height difference means they are locked mechanically into place. Weights 40 and 42 may be doubly-locked with an adhesive sealant.

Line 202 of FIG. 2 represents tthe circumference of a golf ball with center at point 108. The latter is seen to be horizontal length 311 off of the preferred ball striking spot here represented by a point between the geometric center 106 of the ball striking surface 28 and the top 36 of head 22. This information will be used in the explanation of the operation of the invention.

Lastly in FIG. 2, vertical cut plane 4—4 is positioned midway between the heel-side of the union between top 36 and hosel and neck 44 and the inner side 68 of heel cavity 60.

FIG. 3 emphasizes the open outer side 52 and toe cavity brace 84 of toe cavity 46 of head 22. Too, this perspective provides good views of horizontal width 306 of toe weight 40 and horizontal width 310 of head 22. Both of these widths are determined on lines perpendicular to 301 and parallel with ground surface 200 when head 22 is soled in its normal address position as shown. As seen the vertical projections are taken from the extremes toward and away from ball striking surface 28.

Figure 5:
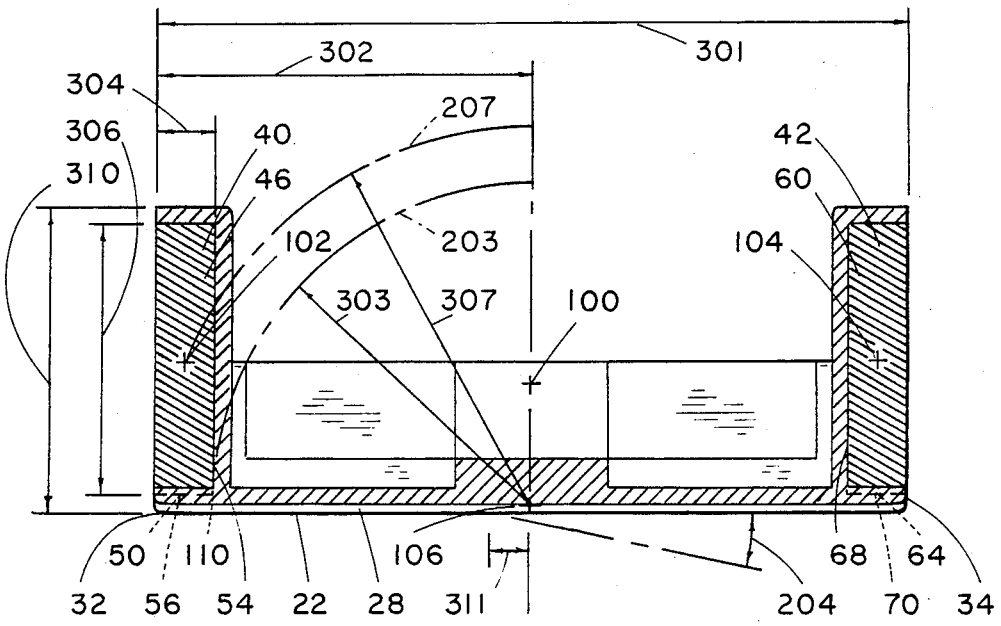
FIG. 5 is a top cross-sectional view of the putter head of the present invention as shown along the line 5—5 of FIG. 2.

It is necessary to remember that dimension set 301, 308, and 310 and dimension set 304, 305, and 306 are part of a single mutually perpendicular measurement system based upon projections so as to distinguish them from dimensions 303 and 307 of FIG. 5 which are direct, horizontal lengths.

A noteworthy feature of FIG. 3 is the large cross-sectional area of toe weight 40 toward open outer side 52. Another way of looking at this is the fact that vertical height 305 is greater than horizontal length 304 and horizontal width 306 is greater than horizontal length 304 of toe weight 40. That both of these ratios may be enhanced to increase the moment of inertia and inertial efficiency is a result of reasoning from both physics and golf. As will be seen, physics teaches us one, or the other, or both may enhanced to infinity to increase moment of inertia and inertial efficiency. Golf teaches us that the toe end 32 of head 22 must be finite in both maximum height 308 and maximum width 310. Therefore, it is golf which implies that both ratios may be made optimal simultaneously. However, this straightforward view implies a regular, or nearly regular geometry of toe weight 40.

Also shown in FIG. 3 is how the ball striking surface 28 relates to the circumference of a golf ball 202 with center at 108 on ground surface 200. Point 102 in the toe cavity 46 represents the center of gravity of toe weight 40. Point 100 in the toe cavity 46 represents the center of gravity of head 22. The center of mass 100 of head 22 is seen to be slightly forward toward ball striking surface 28 and slightly down toward sole 38 from the center of mass 102 of the toe weight 40 due to the generally forward and down contribution of the mass of body casting 26. Also the center of mass 100 of head 22 is seen to be below the center 108 of the circumference of a golf ball 202.

Figure 4:
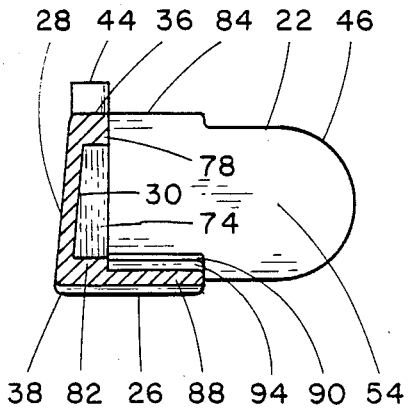
FIG. 4 is a cross-sectional side view of the putter head of the present invention as shown along the line 4—4 of FIG. 2.

With reference to the right-hand-side of FIG. 4, inner side 54 of toe cavity 46 of head 22 is very much in evidence. On the left-hand-side of the diagram, ball striking surface 28, back surface 30, cut-off hosel and neck 44, and sole 38 are clearly manifest. Starting from the top 36, details of the bracing system also become clear. These include: toe cavity brace 84, heel-side brace 78, muscle-back brace 74, side brace 90, middle brace 84, extended sole 88, and heel-side bottom brace 82 of body casting 26.

Regarding FIG. 5, the only hidden lines shown relate to the intersection of the bottom side 50, inner side 54, and shared front side 56 of toe cavity 46 and the intersection of the bottom side 64, inner side 68 and shared front side 70 of heel cavity 60. In toe cavity 46 this intersection defines point 110 which is the closest point of toe weight 40 from the vertical axis 206 (FIG. 6) through through the geometric center 106 of the ball striking surface 28 of head 22. The length from vertical axis 206 through point 106 to partial horizontal circumference 203 which passes through point 110 is shown as the direct horizontal length 303.

Other noteworthy dimensions may also be seen in FIG. 5. These include heel-to-toe length 301; half-length 302; length 304 and breadth 306 of toe weight 40; and the breadth 310 of head 22. Other noteworthy points are also illustrated. These inlcude the center of mass 102 of toe weight 40, the center of mass 104 of heel weight 42, and the center of mass 100 of head 22.

There is also direct horizontal length 307 from vertical axis 206 through the geometric center 106 of the ball striking surface 28 to the partial horizontal circumference 207 which passes through the center of mass 102 of toe weight 40. It leads to the definition of certain other important ratios. The firstt of these is the ratio of direct horizontal length 307 to horizontal half-length 302. Qualitatively, an increase in this ratio squeezes the center of mass 102 of the toe weight 40 farther out toward the toe 32 of head 22. Such an increase has the effect of enhancing the contribution to moment of intertia and inertial efficiency of toe weight 40. Too, the accompanying mass of toe cavity 46 of body casting 26 is also squeezed further out toward the toe 32 of head 22 with similar effect.

The second critial ratio from FIG. 5 is that of the direct horizontal length 303 to the horizontal half-length 302. Increasing the ratio of the length from the nearest point 110 of toe weight 40 from vertical axis 206 through geometric center 106 of ball striking surface 28 to the half-length 302 of head 22 also has the effect of squeezing the toe weight 40 farther out toward the toe end 32 of head 22. Thereby, an increase in this ratio also enhances the moment of inertia and inertial efficiency of head 22.

Once again, there is a difference relating to geometry between the pair of ratios defined in the preceeding two paragraphs. The ratio of the direct horizontal length 307 to the horizontal half-length 302 is quite independent of the exact geometry and position of toe weight 40. The ratio of direct horizontal length 303 to the horizontal half-length 302 is quite dependent on the exact geometry and position of toe weight 40. The thrust of the two ratios, however, is similar with regard to teaching the invention.

Finally in FIG. 5 the angle of twist 204 of head 22 is shown when a ball as represented by circumference 202 as seen in FIG. 2 is miss-struck a distance 311 from the preferred spot. Again, this will be useful in the discussion of the operation of the invention.

FIG. 6, illustrates the toe section 96 of head 22. A prominent feature of this representation is the vertical axis 206 through the geometric center 106 of the ball striking face 28 of body casting 26 when head 22 is soled in its normal address position on ground surface 200. As stated earlier, axis 206 is the preferred practical reference for polar moments of inertia because it is readily determined from direct length measurements of head 22 on ground surface 200. The maximum vertical height 308 from ground surface 200 of head 22 excluding hosel 44 is shown together with the half-height 309. Also illustrated is the toe cavity 46 on the toe 32.

Some data on densities, masses, and dimensions will assist in further description and review. The data in TABLE I are for a head 22 similar to the preferred embodiment of FIGS. 1–6. Also the thickness between the ball striking surface 28 and and back surface 30 is a tenth (0.1) inch. All sides of toe cavity 46 and heel cavity 60 have a similar thickness. However, this thickness and the other dimensions in TABLE I should be taken as illustrative: within the limits of the appended claims, individually or together they may be more or less in the practice of the invention. The material from which this manifestation of head 22 is cast is aluminum, most preferably a strong alloy of aluminum such as A356 available from Robinson Die Casting, Huntington Beach, Calif. 92649. The weights, 40 and 42, are ordinary lead. Again, however, other materials may be substituted within the scope of the appended claims.

OPERATION OF THE INVENTION

Figure 10:
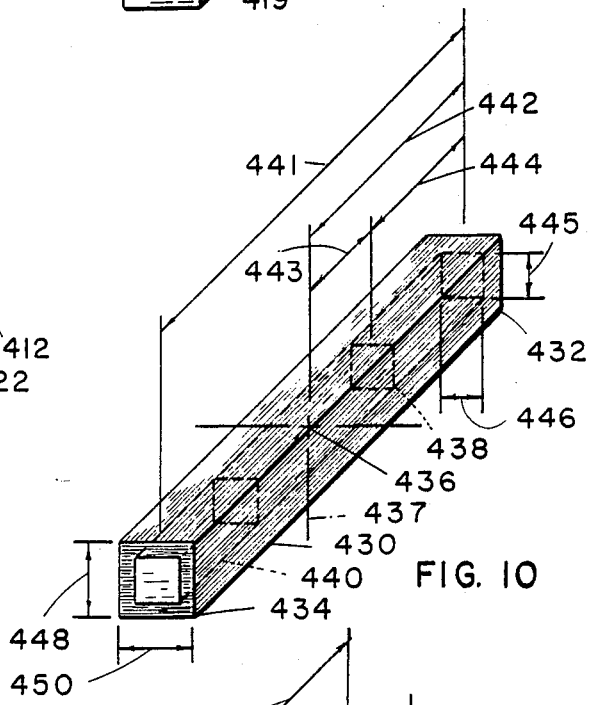
FIG. 10 is a schematic representation of a hollow bar of low density material with weights of a high density material inserted at both ends as a near-putter
Figure 11:
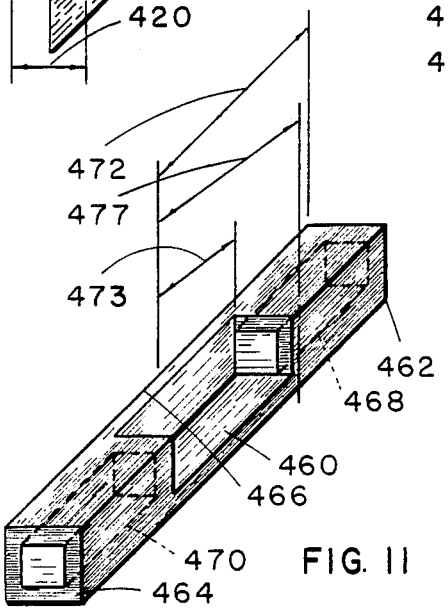
FIG. 11 is a schematic representation similar to FIG. 10 except that two sides of the hollow bar have been cut out in the central portion to eliminate mass in that region.
Figure 12:
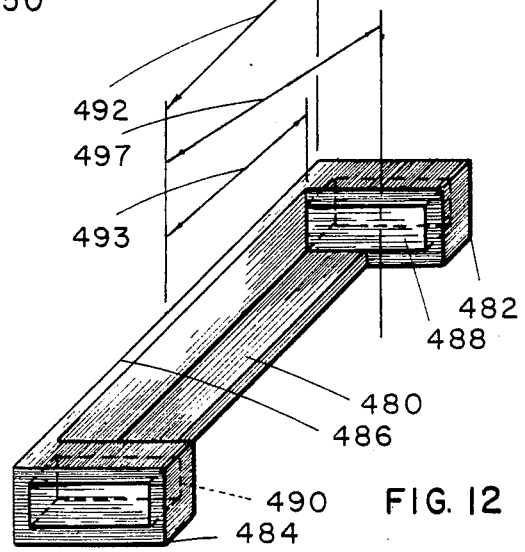
FIG. 12 is a schematic representation similar to FIG. 11 except that the weights have been squeezed farther out toward the poles.

The operation will be explained with the schematic diagrams in FIGS. 7–12 with reference as necessary to the preferred embodiment in FIGS. 1–6. The first three schematic diagrams illustrate key concepts such as inertial efficiency and the errors involved in employing the formulas. In turn, FIGS. 10–12 are used to derive design equations and to show how the conclusions therein may be extended to development of the actual embodiment in FIGS. 1–6.

Figure 7:
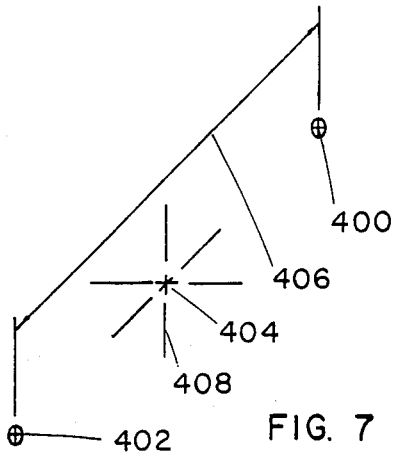
FIG. 7 is a schematic representation of the concept of inertial efficiency.

FIG. 7 reviews the theoretical moment of inertia for a clubhead in the context of inertial efficiency. Here the theoretical design goal is to have half of the mass of a clubhead as a pinpoint at the toe point 400 and half as a pinpoint at the heel point 402.

TABLE I

Density, masses, dimensions, and critical ratios for a preferred embodiment.

| | |
|---|---|
| Density of aluminum | 2.698 g-cm$^{-3}$ |
| Density of lead | 11.34 g-cm$^{-3}$ |
| Mass of body casting 26 with hosel 44 | 101.2 g |
| Mass of hosel 44 | 7.3 g |
| Mass of toe section 96 | 47.0 g |
| Mass of toe weight 40 | 100.2 g |
| Mass of heel weight 42 | 100.2 g |
| Total mass of head 22 | 301.5 g |
| Percentage of mass of toe weight 40 to total mass of toe section 96 with toe weight 40 | 68.06% |
| Ratio of densities, lead to aluminum | 4.203 |
| Horizontal length 301 of head 22 | 5.00 in. |
| Half-length 302 of head 22 | 2.50 in. |
| Direct length 303 | 2.10 in. |
| Length 304 of toe weight 40 | 0.400 in. |
| Height 305 of toe weight 40 | 0.816 in. |
| Width 306 of toe weight 40 | 1.79 in. |
| Direct length 307 | 2.49 in. |
| Height 308 of head 22 | 1.20 in. |
| Half-height 309 of head 22 | 0.60 in. |
| Width 310 of head 22 | 2.01 in. |
| Ratio of length 303 to half-length 302 | 0.840 |
| Ratio of length 307 to half-length 302 | 0.994 |

Points 400 and 402 are the length 406 of a clubhead apart. The center of mass 404 is situated at the midpoint between toe point 400 and heel point 402. The moment of inertia in EQN. 2 is formally calculated about the vertical axis 408 through the center of mass 404.

For the theoretical moment of inertia of the toe section 96 of a head 22 as seen in FIGS. 1–6, and particularly FIG. 6, the entire mass of the toe section 96 is placed at a pinpoint on the extreme of toe 32 a half-length 302 of head 22 away from the vertical axis 206 through the geometric center 106 of ball striking surface 28. The theoretical moment of inertia is then just the mass of toe section 96 times the square of the half-length 302.

The actual moment of inertia of the toe section 96 of a head 22 is also experimentally determined, calculated by formula, or computed from the vertical axis 206 through the geometric center 106 of ball striking surface 28. p As a reminder however, the development and discussion of key theoretical formulas for moment of inertia will be undertaken with a vertical axis through the center of mass. It will then be shown that the application of these formulas about a vertical axis through the geometric center of a ball striking surface will yield conservative values, if done reasonably.

Figure 8:
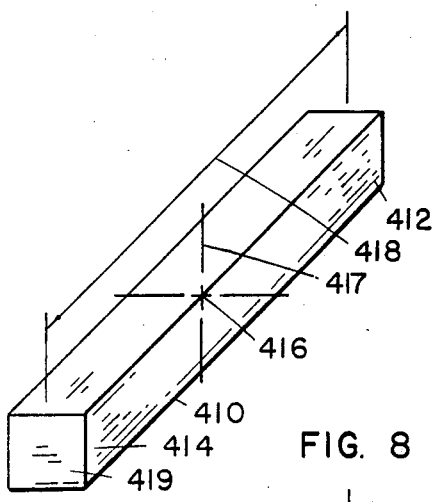
FIG. 8 is a schematic representation of a solid bar as a near-putter.

FIG. 8 illustrates a setup for the development of EQN. 3 and related formulas for a solid bar 410 as a near-putter. The bar 410 has a toe 412, a heel 414, a center of mass 416, a vertical axis 417 through the center of mass 416, a horizontal length 418 between vertical projections of the extremes of the toe 412 and the heel 414, and a cross-sectional area 419. If the bar 410 has a mass, m, and a density, p, and if horizontal length 419 is represented by l and cross-sectional area 419 by A, then from the definition of moment of inertia about an axis 417:

$$I = 2 \int_0^{1/2} l^2 dm \qquad \text{(EQN. 4)}$$

Substitution of dm=pdV and dV=Adl together with integration and simplification lead to:

$$I = 1/12\, pAl^3 \qquad \text{(EQN. 5).}$$

Since the mass, m, equals pAl, EQN. 5 is seen to be another form of EQN. 3. Because EQN. 5 involves both density and cross-sectional area, it is a form of EQN. 3 that leads naturally into a brief digression into the accuracy of the integrated formulas.

Figure 9:
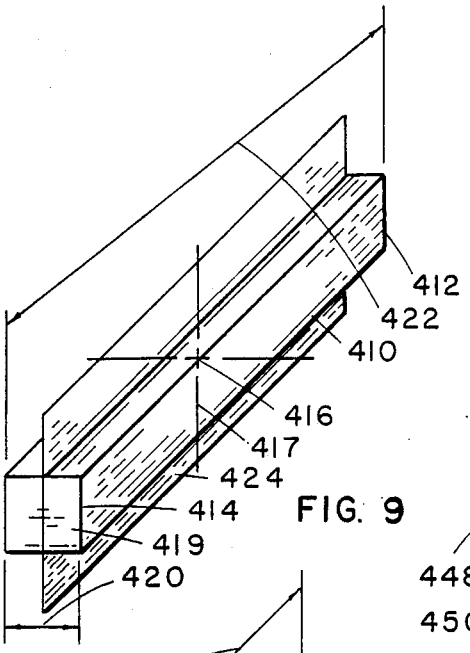
FIG. 9 schematically illustrates the distance error involved in mathematical models of polar moment of inertia on solid bars.

FIG. 9 is the same solid bar 410 as FIG. 8, but instead, it helps to illustrate the assumptions and errors involved in employing EQNS. 3 and 5. The cross-sectional area 419 of the bar has a breadth 420, or x. The bar 410 also has a length-breadth diagonal distance 422 or l'. It is seen that the length-breadth diagonal 422, or l', is greater than the length 418, or l, between the toe 412 and heel 414.

Since l' is greater than l except for points on plane 424 which splits the breadth 420 everywhere in bar 410, EQNS. 3 and 5 are approximations that apply exactly only when l is large and x is small approaching zero. Alternatively, we may say that EQNS. 3 and 5 assume that all of the mass of the bar 410 lies on the plane 424. The relation between l', l, and x is:

$$l'^2 = l^2 + x^2 \qquad \text{(EQN. 6).}$$

For a five-inch long bar that is one-inch wide, $l'^2$ is 26 compared to 25 for $l^2$, the difference being four (4) percent. For a five-inch bar that is two-inches wide $l'^2$ is 29 compared to 25 for $l^2$, the difference being 16 percent. Thus, the difference increases significantly as the width 420 of the bar 410 increases. That the preceeding percentages approximate the actual error involved in the employment of EQNS. 3 and 5 may be seen from computations on mass-bits performed by computer using the definition for moment of inertia. In the algorithm Inertia, the bar 410 is divided into four quadrants.

One of the quadrants is subdivided into 125 equal mass-bits a tenth of an inch square at the top, and the moment of inertia from the vertical axis 417 to the center of mass of each mass-bit is calculated and summed. The moment of inertia of the bar 410 is 4-times the resultant sum. The algorithm itself is brief, and for a 5-inch long, 1-inch wide bar 410 weighing 300 grams, it is:

```
Begin Inertia
Set Inertia-Sum to zero
Set Mass-Bit to 0.600 grams
For I equal 1 to 25 do
For J equal 1 to 5 do begin
Set Length-Bit to ((0.254 × I) − (0.5 × 0.254)) cm
Set Width-Bit to ((0.254 × J) − (0.5 × 0.254)) cm
Set Inertia-Bit to
(Mass-Bit × (Length-Bit² + Width-Bit²)) g cm²
Set Inertia-Sum to (Inertia-Sum + Inertia-Bit) g cm²
End do
Set Head-Inertia to (4 × Inertia-Sum)
End
```

This algorithm yielded a value for Head_Inertia of 4190 g $cm^2$ compared to 4032 g $cm^2$ from EQNS. 3 and 5, or a 3.92 percent difference.

For the case of a 5-inch long, 2-inch wide bar 410 weighing 300 grams, the variable Mass-Bit was set to 0.300, and the range of J changed to 1 to 10. The algorithm then yielded a value for Head Inertia of 4674 g $cm^2$ compared 4032 g $cm^2$ from EQNS. 3 and 5, or a 15.9 percent difference. It is seen that these percentages are about the same as determined from the length differences with EQN. 6.

To summarize on the issue of accuracy, the values for moment of inertia obtained from the formulas are generally low—provided minimum distances such as l, and not maximum distances such as l', are used. In one important sense this is beneficial since the values can be taken to be conservative with confidence. While the results of the mass-bit computations are more accurate, an analysis to determine whether or not a given result is conservative is difficult and potentially laborious for a system of any complexity.

Turning now to the issue of design, it can be shown that expressions such as EQN. 5 provide helpful insight into the design of inertially efficient systems. From the definition of inertial efficiency in EQN. 1 and FIG. 7, we have seen that the moment of inertia might be increase by moving mass away from the center of a solid bar 410 in FIGS. 8 and 9. A first step toward moving mass away from the center of a near-putter is illustrated schematically in FIG. 10. Here the bar of FIGS. 7 and 8 is hollowed out with weights filling the ends.

In FIG. 10, a minimum of hidden lines have been drawn to illustrate that bar 430 is hollow with a toe weight 438 at the toe 432 and with a heel weight 440 at the heel 434 of the hollow part. The center of mass 436 of this system is located at the center of hollow bar 430 since the weights 438 and 440 are here equal in size and mass.

Hollow bar 430 has a length 441 from toe 432 to heel 434, or $l_1$, and it has a half-length 442, or $l_2$, from vertical axis 437 through center of mass 436 to toe 432. It has a height 448 and a width 450 which when multiplied yield the total cross-sectional area. If the cross-sectional area, $A_2$ of a weight 438, defind below is subtracted from the total cross-sectional area of hollow bar 430, the cross-sectional area, $A_1$, is obtained. $A_1$ is seen to be the cross-sectional area of the material part of holow bar 430. Its mass is, $m_1$, and its density is $p_1$.

Length 443, or $l_3$, is the distance from the center of mass 436 to the toe weight 438. The length 444 or $l_4$ of toe weight 438 is just $l_3-l_2$. It has a height 445 and a width 446 which when multiplied yield its cross-sectional area, $A_2$. Each of the weights 438 and 440 has a mass $m_2/2$ and a density $p_2$. The total mass of the system is $m_1+m_2$.

The moment of inertia, I, for the entire system of FIG. 10 is the sum of the contribution from the hollow bar, $I_1$, and the contribution from the weights, $I_2$. It is seen that $I_1$ for the hollow bar is still approximated by EQNS. 3 and 5 with the subscript 1 appended to the various terms. The moment of inertia for the two weights, $I_2$, is:

$$I_2 = 2p_2A_2 \int_{l_3}^{l_2} l^2 dl \qquad \text{(EQN. 7)}$$

Integration and substitution gives:

$$I_2=\tfrac{2}{3}p_2A_2(l_2^3-l_3^3) \qquad \text{(EQN. 8)}$$

Substituting $l_1=2l_2$ in EQN. 5, the moment of inertia for the system becomes:

$$I=\tfrac{2}{3}(p_1A_1l_2^3+p_2A_2(l_2^3-l_3^3) \qquad \text{(EQN. 9).}$$

There are two more forms of the same expression of immediate interest. Since the cubic terms within the inside of the parentheses of EQN. 10 may be factored with one of the factors being $(l_2-l_3)$ which is the length of a weight, and since $A_2p_2(l_2-l_3)$ is just $m_2/2$:

$$I=\tfrac{1}{3}(m_1l_2^2+m_2(l_2^2+l_2l_3+l_3^2)) \qquad \text{(EQN. 10)}$$

Still another useful form of EQN. 9 follows from substitution of $m_1/V_1$ and $m_2/V_2$ for $p_1$ and $p_2$, respectively:

$$I=\tfrac{2}{3}(m_1(A_1/V_1)l_2^3+m_2(A_2/V_2)(l_2^3-l_3^3)) \qquad \text{(EQN. 11).}$$

The fundamental distinction between the $I_1$ and $I_2$ terms in EQNS. 9–11 is the existence of the $l_3$-parameter in the the latter. The significance of $l_3$, or the length from the center of mass to the toe weight in FIG. 10, is understood most readily in EQN. 10.

Let us assume for purposes of illustration that $m_1$ and $m_2$ in EQN. 10 are equal. Then, as $l_3$ is made larger approaching $l_2$ in magnitude, the $I_2$ term clearly dominates the $I_1$ term, becoming in the limit where $l_3=l_2$ three-times as great. Hence, $l_3$ is a parameter that indicates weights 438 and 440 should be squeezed as far as possible toward the toe 432 and heel 434, respectively, to increase the total moment of inertia, I. p The counter-argument could be made that the preceeding is inconclusive because weights 438 and 440 are not absolutely essential in the achievement of a high moment of inertia. For example, material at $p_1$ could be taken from the center of hollow bar 430 and squeezed into thin sheets onto larger surface areas at the toe 432 and heel 434 giving a similar moment of inertia. This conclusion is seen to be incorrect for the following reason: the area and space around the heel and toe of any near-putter or real golf clubhead is limited, and given a limited area and space, it is readily seen there will always exist a high density film at $p_2$ which can be squeezed thinner than a low density film at $p_1$.

The idea of squeezing the weights toward the poles is fully consistent with the initial concept of promoting a greater inertial efficiency. However, rather than pinpoints of mass, ENQS. 9–11 suggest that the ideal of a high inertial efficiency can be achieved in practical terms by attaching the weights in thin expanded surfaces in the extreme region of the poles. The idea of squeezing the weights onto the poles may be expressed as a design ratio; in this case the enhancement of the squeezing ratio, $l_3/l_2$.

Once the potential dominance of the second terms in EQNS. 9–11 is realized, other key design ratios also become manifest. Thus, from EQN. 9, the ratio $p_2/p_1$ should be made as great as possible. From EQNS. 10 and 11, the ratio $m_2/(m_1+m_2)$ should be made as large as feasible. Finally, from EQN. 11, the cross-sectional area-to-volume ratio, $A_2/V_2$, of weights 438 and 440 should be enhanced. It is seen that this ratio may be increased by simultaneously enhancing the ratio of height 445 to length 444 and the ratio of width 446 to length 444 of toe weight 438 with similar adjustments for heel weight 440.

The data in Table II on moments of inertia and inertial efficiencies on four cases of FIG. 10 help to illustrate the significance of EQNS. 9–11. It is seen that the hollow bar 430 is of either aluminum or magnesium, and weights 438 and 440 are of lead or tungsten. It is emphasized that these elements were selected for illustrative purposes only. Other elements such as graphite, alloys, or compositions could be selected as well. Also, in every case weights 438 and 440 are positioned at the ends of hollow bar 430 as depicted in FIG. 10. In Part B of Table II, the open values were calculated using EQN. 10, and the values in parentheses were computed on an IBM Personal Computer employing the mass-bit algorithm.

The most striking feature is that the moments of inertia and inertial efficiencies are approximately twice that for a similar five-inch, 300 gram solid bar 410 such as depicted in FIGS. 8 and 9. Too, it is seen in Table II, that the total values for the mass-bit computations are only very slightly larger than the total values from the formula computations using EQN. 10. This is because most of the contribution to moment of inertia comes from weights 438 and 440 which are distant from vertical axis 437 through center of mass 436 where relative length errors are lower.

The results in Table II support the notion that the lower the density of the low density material in the hollow bar 430, and the higher the density of the high density material in the weights 438 and 440, the greater the moment of inertia and inertial efficiency. On the low density side, Mg-Pb edges Al-Pb and Mg-W edges Al-W. On the high density side, Al-W takes Al-Pb and Mg-W takes Mg-Pb. The reason for the small differences on the low density side has to do with the fact that $l_3/l_2$ decreases in the systems with magnesium.

TABLE II

Moments of inertia and inertial efficiencies for 300 gram systems of varying density as illustrated in FIG. 10.

| Part A. Critical data | |
|---|---|
| 1. Density of magnesium | 1.74 g/cm$^3$ |
| 2. Density of tungsten | 19.35 g/cm$^3$ |
| 3. Length 441 of hollow bar 430 | 5.00 in. |
| 4. Height 448 of hollow bar 430 | 1.00 in. |
| 5. Width 450 of hollow bar 430 | 1.00 in. |

TABLE II-continued

Moments of inertia and inertial efficiencies for 300 gram systems of varying density as illustrated in FIG. 10.

| | |
|---|---|
| 6. Height 445 of toe weight 438 | 0.800 in. |
| 7. Width 446 of toe weight 438 | 0.800 in. |

Part B. Results (g cm$^2$)

| Moments of inertia for hollow bar 430 | |
|---|---|
| Aluminum | Magnesium |
| 1070 (1140) | 690 (735) |

| Moments of inertia for toe weight 438 and heel weight 440 | | | |
|---|---|---|---|
| Lead | Tungsten | Lead | Tungsten |
| 6,000 (6,070) | 7,100 (7,170) | 6,420 (6,500) | 7,770 (7,850) |
| Total moments for hollow bar 430 and weights 438 and 440 | | | |
| 7,070 (7,210) | 8,170 (8,310) | 7,110 (7,240) | 8,460 (8,590) |
| Inertial efficiencies | | | |
| 0.585 (0.596) | 0.675 (0.687) | 0.588 (0.598) | 0.699 (0.710) |

Conversely, the reason for the large differences on the high density side has to do with fact that this same ratio increases dramatically for the systems with tungsten.

There is also testimony that the greater the ratio $m_2/(m_1+m_2)$, the greater the moment of inertia and inertial efficiency. This ratio was 249/300 for the magnesium systems and 220/300 for the aluminum systems. These ratios follow density and the results given for density above.

The results in Table II, when viewed in the perspectives of cross-sectional area-to-volume or surface area-to-volume ratios of weights 438 and 440 also follow density. In these systems $A_2$ is a constant, and density is proportional to 1/V so that the ratios are also proportional to density. Hence Al-W is superior to Al-Pb and Mg-W is better than Mg-Pb by wide margins because of the larger ratios inherent in the density of tungsten over that of lead. A similar analysis also applies to the ratio $l_3/l_2$. Because the tungsten weights 438 and 440 are shorter than their lead counterparts; $l_3$-values, $l_3/l_2$-ratios, moments of inertia, and inertial efficiencies increase for the former.

Quite clearly, significant gains in moment of inertia and inertial efficiency could be expected for any change which simulataneously enhances each of the ratios $p_2/p_1$, $m_2/(m_1+m_2)$, $A_2/V_2$, and $l_3/l_2$.

However, as illustrated in FIG. 11, some gain can be made by adjusting only one or two of the ratios; in this case primarily the ratio, $m_2(m_1+m_2)$. FIG. 11 is similar to FIG. 10 except that two sides of the modified hollow bar 460 have been cut out in the central portion to eliminate mass in that region and to add mass into weight 468 at the toe 462 and weight 470 at the heel 464. Only hidden lines sufficient to illustrate the detail of the weights 468 and 470 are shown.

In FIG. 11 the approach toward handling the dimensions of the system has changed slightly from that in FIG. 10. Now, the half-length 472 of modified hollow bar 460 is represented along the facial edge 466 from the extreme of toe 462. Although this half-length is the same as length 442 in FIG. 10, it is now positioned to identify the middle of the facial edge 466. In this regard half-length 472 is similar to half-length 302 in FIGS. 1–6.

Direct length 473 from the vertical projection of the middle of facial edge 466 to the vertical projection of the nearest point of toe weight 468 is almost the same as length 443 except that now in the assymetric system the former is considered to be more specific and useful than the latter. Direct length 473 is similar to direct length 303 in FIG. 5.

Finally in FIG. 11, direct length 477 from the vertical projection through the middle of facial edge 466 to a vertical projection from the center of mass of toe weight 468 has no counterpart in FIG. 10, and it is introduced here because it has a lower geometric dependence than direct length 473. Direct length 477 is similar to direct length 307 in FIG. 5.

There are two aspects of FIG. 11 which may be a cause of concern regarding the applicability of EQNS. 9–11. The first is the translation away from an axis through the center of mass to an axis through the middle of a vertical face as a potential reference for moment of inertia. Provided that the length of weight 468 is projected perpendicularly onto a line parallel with half-length 472, the formulas may still be applied. However, it is also necessary to remember that the translation increases the distance error, and thereby the error in the resultant moment of inertia. However, the increase in error in moment of inertia is in the direction of a slightly more conservative result.

The second aspect is the fact that the system of FIG. 11 is no longer a perfectly symmetric hollow bar. This does indeed mean that EQNS. 9–11 are no longer applicable in the straightforward form they are written. For example, the system of FIG. 11 would now require three terms in a formula to calculate a resultant moment of inertia. Two of the terms would be identical with the present terms in, say, EQN. 10. Only now the first term in EQN. 10 would apply to the two long sides of modified hollow bar 460. The second term in EQN. 10 would apply to weights 468 and 470 as before. The new third term in EQN. 10 would be similar in form to the second term but would apply instead to the four short sides of modified hollow bar 460 that surround weights 468 and 470.

In the sense that they are only applicable as written and that they yield very accurate results, EQNS. 9–11 are not valuable as equations for design. In the sense that their terms can be modified as appropriate to yield conservative approximations and insight, EQNS. 9–11 are general equations of design for heel and toe weighting of golf clubheads. In this regard, the system in FIG. 12 is of interest.

While very limited gains in moment of inertia and inertial efficiency can be expected from the system of FIG. 11 compared to FIG. 10, larger gains can be anticipated from the further modifications shown in FIG. 12. The basic difference is that in FIG. 12 toe weight 488 and heel weight 490 have been squeezed further out toward the toe 482 and the heel 484, respectively, of re-modified hollow bar 480. Once again, only the hidden lines relating to the weights 488 and 490 have been drawn. With the exception of hosel 44 and an appropriate loft on the ball striking face 28, remodified hollow bar 480 is similar in many respects to the preferred embodiment of head 22 illustrated in FIGS. 1–6.

The various lengths shown in FIG. 12 are similar to those in FIG. 11. Hence, half-length 492 of re-modified hollow bar 480 is shown along the facial edge 486 from the extreme of the toe 482. Length 493 is the distance from a vertical projection through the middle of facial edge 486 to a vertical projection from the closet point of toe weight 488. Length 497 is the distance from a vertical projection through the middle of facial edge 486 to a vertical projection from the center of mass of toe 488.

In qualitatively comparing FIG. 12 with FIG. 11, it is seen that increases have been made in several key ratios. First, the ratio of the direct length 493 to half-length 492 in FIG. 12 has increased over the ratio of direct length 473 to half-length 472 in FIG. 11. Second, the ratio of the direct length 497 to half-length in FIG. 12 has increased over the ratio of the direct length 477 to the half-length 472 in FIG. 11. Too, and although it is not shown dimensionally on the diagrams, the cross-sectional area-to-volume ratio of toe weight 488 in FIG. 12 is greater than the corresponding ratio for toe weight 468 in FIG. 11. From EQNS. 9–11 it is seen that all of these factors will tend to enhance the polar moment of inertia and inertial efficiency of the re-modified hollow bar 480 in FIG. 12. Since the object in FIG. 12 is similar to the preferred embodiment of FIGS. 1–6, the latter should also possess highly enhanced polar inertial characteristics, and indeed, computations confirm this.

From formula computations the toe section 96 of head 22 as configured in Table I had a polar moment of inertia of 4170 g-cm$^2$ and an inertial efficiency of 0.702. Since hosel 44 was of low mass and very close to vertical axis 206 through the geometric center 106, its contribution was minor so that symmetry requires head 22 to have had a formula moment of inertia in slight excess of 8340 g-cm$^2$. Additionally, mass-bit computations gave 5,100 g-cm$^2$ for toe section 96 and 10,200 g-cm$^2$ for head 22 less hosel 44. The mass-bit value was 22.4% larger than the formula value, in the range expected.

In arriving at the preceding values, formula and mass-bit computations were conducted on the thirteen components of toe section 96. Certain minor geometric approximations were made in the conduct of the computations. The flavor of these may be understood by considering the most important approximation made. It was on the heaviest component, toe weight 40. As indicated previously and as seen in FIG. 2, the inner side 54 was higher than the open outer side 52 of toe cavity 46, the values being 0.816 and 0.800 inch, respectively. For the computations, the average value of 0.808 inch was used. The error in employing this approximation was found to be less than 1% by comparing the moments of inertia for mass-bits near the inner side 54, middle, and open outer side 52 of toe cavity 46. Similar considerations on the other components where lesser approximations were made gave a total error also in the 1% range. It is further noted that the 1% range is over an order of magnitude smaller than the 22.4% range between the formula and mass-bit computations so that the formula-value is conservative.

Accordingly, with a head 22 possessing a polar moment of inertia in excess of 8000 g-cm$^2$, it is seen in FIGS. 2 and 5 that when a ball as represented by circumference 202 is miss-struck a distance 311 from the preferred point 106, the angle of twist 204 tends to be greatly reduced.

SCOPE AND CONCLUSIONS

Although the golf club putter head 22 of FIGS. 1–6 is described herein as a preferred embodiment, I do not intend to limit the invention to this type of club. Indeed, it will be readily seen that the principles, practices, variations, modifications, and equivalents of the preferred embodiment of this invention may be readily applied to all classes of clubs including as well other monofacial putters, bifacial putters, woods, irons, and utility clubs as included within the spirit and scope of the appended claims.

The position of hosel 44 is not critical to this invention. Head 22 may be center-shafted as illustrated in FIGS. 1–6; or it may be heel-shafted; or less likely, in the case of putters, it may even be toe-shafted. If a part or all of hosel 44 resides in the toe section 96, then its proportional contribution to the mass, moment of inertia, and inertial efficiency should be included in that section. In fact, hosel 44 is optional as other known means such as a simple hole in head 22 would do to attach shaft 24.

That front side 56 of cavity 46 efficiently shares back surface 30 is a convenient though not absolutely necessary, feature of the practice of the current invention. As another acceptable possibility side 56 could be separated from back surface 30 with braces and closed.

Similarly, the open outer side 52 of cavity 46 is, indeed, open is merely an advantageous feature of the current invention. When open side 52 is located in this manner, it may be turned upward so that a melted weight 40 may be poured or so a that pre-cast weight 40 may be placed in in cavity 46. If weight 40 is pre-cast, it may be sealed in place with adhesive cement and doubly-locked with a set screw. Accordingly, many methods of securing weight 40 are acceptable.

While, it has been shown that locating weight 40 at the extreme of toe 32 toward open outer side 52 has manufacturing convenience and physical advantage in reference to moment of inertia and inertial efficiency, with only slight loss of manufacturing convenience and physical advantage, any of the other sides of cavity 46 might be so open. Also, any of the sides of cavity 46 which are open, might be closed after the weight material is placed in head 22. Finally, it is seen that the thrust of this invention is not so much on cavity 46 at all. Rather, it is the position of toe weight 40 relative to a vertical axis 206 through the geometric center 106 of the ball striking surface 28 that is more important.

This prompts a practical definition for a cavity 46 which is generally regarded to be a hollow. Accordingly, for a cavity 46 to exist, there will be something more than one flat side. If, for example, tungsten were used in weight 40, it could be bonded directly onto back surface 30, and clearly, a cavity 46 would not exist. However, if weight 40 was bonded and in any way braced to back surface 30, then a cavity 46 would exist even if it was not everywhere contiguous. Similarly, if weight 40 were placed, electroplated, vapor-depositied, or the like on the interior of a hollow iron or wood club, a pre-existing cavity 46 would exist.

There are three reasons why toe weight 40 is located in an approximately satisfactory position as shown in FIGS. 1–6. First, it is desirable to attain the highest possible separation of masses, and this can be done most efficiently in a simple model with a ball striking surface 28 and a toe weight 40 as primary components and with a toe cavity 46 and a system of braces including extended sole 88 as secondary components. If toe weight 40 is placed more directly behind geometric center 106 along lines 203 and 207 as seen in FIG. 5, then the mass requirement for the secondary components, and particularly for extended sole 88, increase.

Secondly, if much of the mass of toe weight 40 were moved very far behind the region of geometric center 106 of ball striking surface 28, the center of mass 100 of head 22 would tend to move back away from geometric center 106 and head 22 would become awkward and ineffective in use.

Thirdly, from moment of inertia and inertial efficiency perspectives, it is seen that something approximating the current configuration where the center of mass 102 of toe weight 40 is distant from geometric center 106 is advantageous. Furthermore, the mass of toe weight 40 in rounded back side 58 of toe cavity 46 is in a particularly effective position.

The preceeding considerations indicate that having a substantial portion of toe weight 40 in the region of the toe 32 behind ball striking surface 28 is a part of this invention. As implied in FIG. 5, either or both points 102 and 110 may be moved somewhat along lines 203 and 207, respectively. Too, toe weight 40 could be extended elsewhere and the invention would still retain its essential spirit. If toe cavity 46 were made radial, or approximately so, the the interpretation of width 306 should be interpreted as the maximum partial horizontal circumference of toe weight 40 and length 304 as the thickness of the partial cylinder.

Conversely, toe weight 40 need not be extended nearly so far behind ball striking surface 28 as illustrated in FIGS. 1–6. If, for example, tungsten were used as material for toe weight 40, the horizontal widths 306 and 310 of toe weight 40 and head 22, respectively, could be substantially reduced because of tungsten's greater density relative to lead.

Turning to the absolute data on masses and dimensions for head 22 as set forth in Table I; these are not particularly critical to the invention. For a small child's clubhead, they might be less. For a large adult's clubhead, they might be more. However, the values of the ratios set forth in Table I are of importance because they define the ranges of the ratios set forth in the appended claims.

Similarly, the data in Table II should be regarded only as a way to illustrate the theory as set forth in EQNS. 1–11. That data and its interpretation relative to the theory are included with the hope that it will provide understanding and help to spur future developments. The data supports two key notions relating to moment of inertia and inertial efficiency which are background for the appended claims. The first is the superiority of a near-clubhead made from materials of two densities over one made from a material of only one density. The second is that the lower the density of the low density material and the higher the density of the high density material, the better the near-clubhead.

We do not wish to be bound by the path of the development of the theory or the resultant theory itself beyond that necessary for the appended claims. Other starting points and other pathways could lead to similar conclusions. The theory is regarded as a separate entity that guided the definition of several empirical design ratios that are helpful in describing the invention. This empirical realm of ratios covers masses, densities, lengths, surface areas, and inertial efficiencies.

The key to the current invention is the equating of a conceptual pinpoint of mass at the toe 32 to a practical expanded surface of a weight 40 at the toe 32. This surface may be flat as illustrated or it may bulged, concave, irregular, multiple, or the like. Similarly, as suggested above, it need not be uncovered and it need not be positioned on the extreme of toe 32 as illustrated in FIGS. 1–6.

Perhaps as indirect means is the best way to view this expanded surface. It involves placing a first mirror perpendicular to length line 301 just beyond toe 32 and viewing toe weight 40 as if it were completely uncovered, but in its correct position relative to cavity 46 and casting 26. The surface visible in the mirror is primarily that of weight 40 along open outer side 52, but also visible is the surface of weight 40 along bottom side 50 of cavity 46. Together these two surfaces sum to the magnitude of th surface of toe weight 40 along inner side 54 of cavity 46. As suggested earlier, this quest for a two-dimensional expanded surface may ultimately translate into a real three-dimensional, erect wall-like configuration of at least a portion of toe weight 40.

What is claimed is:

1. A golf clubhead comprising:

a. a toe and heel, a front and rear, and a top and sole with an elongated ball striking surface toward said front;

b. a fastening means to affix a shaft between said heel and said toe;

c. a geometric center of said striking face, and a vertical axis through said geometric center;

d. a toe section and a heel section;

e. a body casting of a material having a predetermined lower density, said body casting comprising in said toe section a portion of said elongated ball striking surface, and at least one toe cavity; and f. said toe section of said head from a plane perpendicular to the length line of said head through said geometric center to the extreme of said toe comprising:

i. a toe weight means comprising at least one toe weight attached to said clubhead in said toe cavity, whereby each of said toe weights is of a material having some predetermined higher density greater than said predetermined lower density of said body casting;

ii. a mass distribution means to decrease the relative mass consisting of said body casting and said toe weight means in the region of said toe section near the center of mass of said clubhead and to position a most substantial portion of the mass of said toe weight means adjacent said toe behind said ball striking surface; and iii. a characteristic feature of said most substantial portion of said toe weight means adjacent said toe comprising a relatively thin expanded surface whereby both the width and the height of said toe weight means are generally greater than the length of said relatively thin expanded surface to resist twisting forces when a golf ball is struck.

2. The golf clubhead of claim 1 whereby the ratio of masses of said toe weight means to the total mass of said toe section is at least 0.15; and whereby the ratio of densities of said toe weight means to said body casting is at least 1.20.

3. The golf clubhead of claim 2 whereby said toe weight means includes a tungsten-containing material to enhance the density of said toe weight means to at least 13.0 grams per cubic centimeter.

4. The gold clubhead of claim 2 whereby said toe weight means has both a width and a height greater than its length and generally runs parallel with the width line of said clubhead.

5. The golf clubhead of claim 4 whereby the inertial efficiency of said toe section as determined from said vertical axis is at least 0.50.

6. The golf clubhead of claim 2 whereby said ratio of masses is at least 0.60; and whereby said ratio of densities is at least 4.0.

7. The golf clubhead of claim 6 whereby said toe weight means includes a tungsten-containing material to enhance the density of said toe weight means to at least 13.0 grams per cubic centimeter.

8. The golf clubhead of claim 6 whereby the ratio of the horizontal length between said vertical axis through said geometric center of said ball striking surface and the closest point to said toe weight means relative to the half-length of said clubhead is at least 0.80.

9. The golf clubhead of claim 8 whereby the inertial efficiency of said toe section as determined from said vertical axis is at least 0.65.

10. A golf clubhead comprising:

a. a toe and heel, a front and rear, and a top and sole with an elongated ball striking surface toward said front;

b. a fastening means to affix a shaft between said heel and said toe;

c. a geometric center of said striking face, and a vertical axis through said geometric center;

d. a toe section and a heel section;

e. a body casting of a material having a predetermined lower density, said body casting comprising in said toe section a portion of said elongated ball striking surface, and at least one toe cavity; and f. said toe section of said head from a plane perpendicular to the length line of said head through said geometric center to the extreme of said toe comprising:

i. a toe weight means comprising at least one toe weight attached to said clubhead in said toe cavity, whereby each of said toe weights is of a material having some predetermined higher density greater than said predetermined lower density of said body casting;

ii. a mass distribution means to decrease the relative mass consisting of said body casting and said toe weight means in the region of said toe section near the center of mass of said clubhead and to position the center of mass of said toe weight means adjacent said toe behind said ball striking surface; and iii. a characteristic feature of said toe weight means adjacent said toe comprising a relatively thin expanded surface whereby both the width and the height of said toe weight means are generally greater than the length of said relatively thin expanded surface to resist twisting forces when a golf ball is struck.

11. The golf clubhead of claim 10 whereby the ratio of mass of said toe weight means to the total mass of said toe section is at least 0.15; and whereby the ratio of densities of said toe weight means to said body casting is at least 1.20.

12. The golf clubhead of claim 11 whereby said toe weight means includes a tungsten-containing material to enhance the density of said toe weight means to at least 13.0 grams per cubic centimeter.

13. The golf clubhead of claim 12 whereby the inertial efficiency of said toe section as determined from said vertical axis is at least 0.50.

14. The golf clubhead of claim 11 whereby said ratio of masses is at least 0.60; and whereby said ratio of densities is at least 4.0.

15. The golf clubhead of claim 14 whereby said toe weight means includes a tungsten-containing material to enhance the density of said toe weight means to at least 13.0 grams per cubic centimeter.

16. The golf clubhead of claim 14 whereby the ratio of the horizontal length between said vertical axis through said geometric center of said ball striking surface and said center of mass of said toe weight means relative to the half-length of said clubhead is at least 0.90.

17. The golf clubhead of claim 16 whereby the inertial efficiency of said toe section as determined from said vertical axis is at least 0.65.

* * * * *